US009079446B2

(12) United States Patent
Pal et al.

(10) Patent No.: US 9,079,446 B2
(45) Date of Patent: Jul. 14, 2015

(54) PHOTO MEDIA

(75) Inventors: Lokendra Pal, San Diego, CA (US); Xulong Fu, San Diego, CA (US); Christine E. Steichen, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 81 days.

(21) Appl. No.: 13/879,734

(22) PCT Filed: Oct. 29, 2010

(86) PCT No.: PCT/US2010/054731

§ 371 (c)(1),
(2), (4) Date: Apr. 16, 2013

(87) PCT Pub. No.: WO2012/057785

PCT Pub. Date: May 3, 2012

(65) Prior Publication Data

US 2013/0201251 A1 Aug. 8, 2013

(51) Int. Cl.

| | |
|---|---|
| ***B41M 5/00*** | (2006.01) |
| ***B41M 5/50*** | (2006.01) |
| ***B41M 5/52*** | (2006.01) |
| ***B41M 7/00*** | (2006.01) |
| ***G03C 1/76*** | (2006.01) |

(52) U.S. Cl.

CPC ..... *B41M 5/502* (2013.01); *B41M 5/504* (2013.01); *B41M 5/506* (2013.01); *B41M 5/508* (2013.01); *B41M 5/5218* (2013.01); *B41M 5/5254* (2013.01); *B41M 7/0027* (2013.01); *G03C 1/7614* (2013.01)

(58) Field of Classification Search

CPC .. B41M 5/508; B41M 5/5218; B41M 5/5254; B41M 5/506; B41M 5/504; B41M 5/502

USPC ..... 428/32.2, 32.22, 32.34, 32.38

See application file for complete search history.

(56) References Cited

U.S. PATENT DOCUMENTS

| | | | | |
|---|---|---|---|---|
| 4,581,267 | A | 4/1986 | Miller | |
| 6,030,742 | A | 2/2000 | Bourdelais et al. | |
| 7,520,959 | B2 | 4/2009 | Kikuchi | |
| 2002/0008752 | A1 * | 1/2002 | Tokunaga et al. | 347/106 |
| 2002/0146542 | A1 | 10/2002 | Lu et al. | |
| 2007/0207278 | A1 | 9/2007 | Mukherjee | |
| 2007/0218254 | A1 | 9/2007 | Zhou et al. | |
| 2008/0044633 | A1 * | 2/2008 | Ming et al. | 428/201 |
| 2008/0182749 | A1 | 7/2008 | Tohmatsu et al. | |

FOREIGN PATENT DOCUMENTS

| | | | |
|---|---|---|---|
| CN | 1257222 | A | 6/2000 |
| JP | 2010036343 | A | 2/2010 |
| WO | WO-9002973 | A1 | 3/1990 |
| WO | WO-2010098770 | A1 | 9/2010 |

* cited by examiner

*Primary Examiner* — Betelhem Shewareged

(74) *Attorney, Agent, or Firm* — VanCott, Bagley, Cornwell

(57) ABSTRACT

A photo media may comprise a substrate, the substrate having an image receiving side and a non-image receiving side, an extruded barrier layer disposed on the non-image receiving side of the substrate, and a laminate layer disposed on the image receiving side of the substrate after an ink layer is printed. The photo media may further comprise an image receiving layer disposed on the image receiving side of the substrate between the substrate and the laminate layer.

16 Claims, 7 Drawing Sheets

PHOTO MEDIA

BACKGROUND

An increase in demand for and access to digital photography products and services have caused an increase in demand for high quality products such as photo media that can be used in a high speed production speeds. Further, the ability of a user to simply send digital copies of images to a photo shop or other photofinishing service has proven to be a convenient means of obtaining physical copies of the images for a consumer, and economically advantageous for the service provider. In recent years, there has been a transition from analog to digital photo printing. The increase in demand has created need for high speed production of photos at, for example, centralized print service providers. The commercially available papers such as offset type media require additional surface treatments and processing to address inadequate photo quality and ink or toner adhesion. Further, curl control is also often a significant challenge. Significant progress has been made in developing digital presses that address demands for better performance and high speed photo production. Despite these advances in digital presses, improvements in photo media with good ink adhesion, print uniformity, easy curl control, and a good photo feel may still be made.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Figure 1:
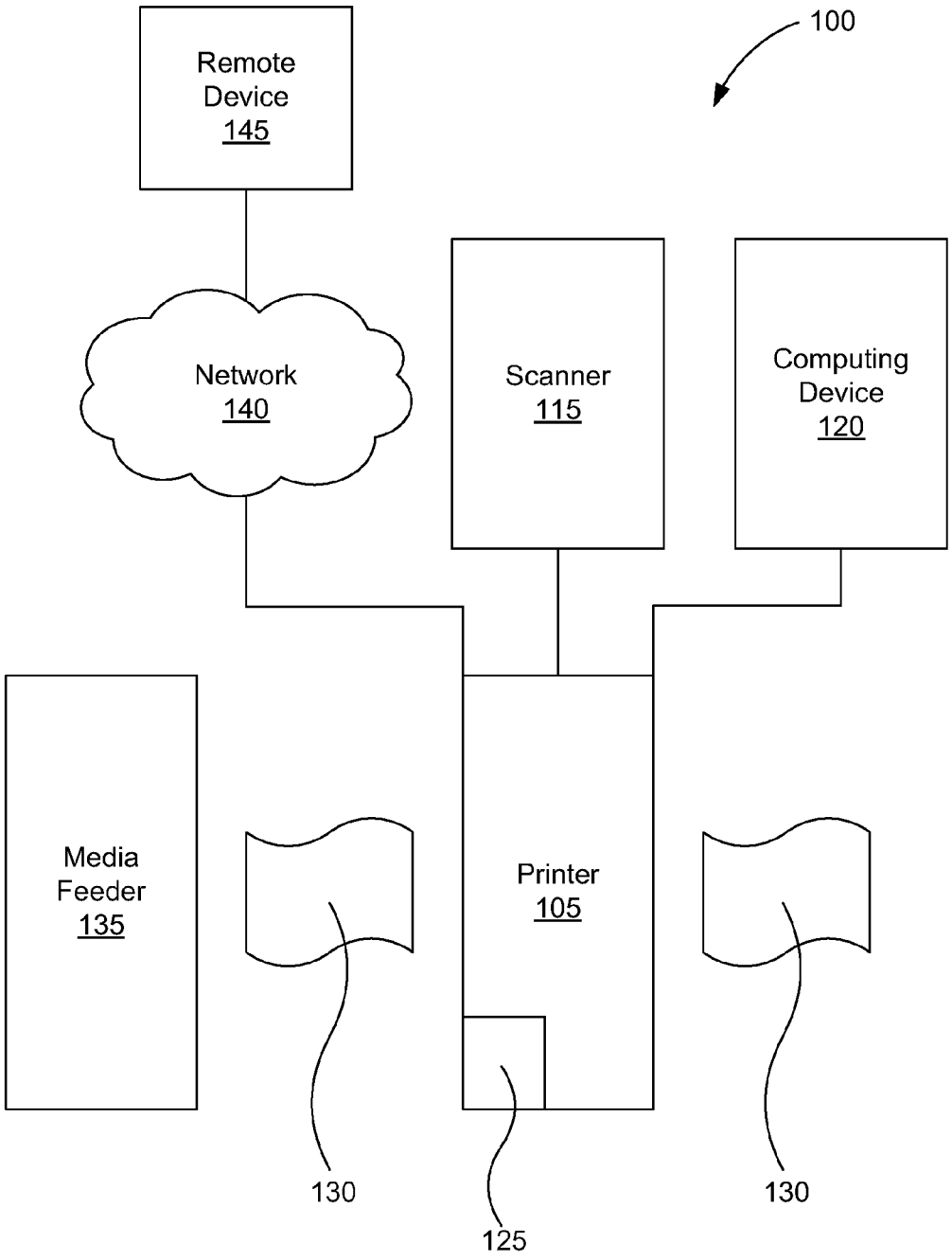
FIG. 1 is a block diagram of an illustrative photographic processing system, according to one example of the principles described herein.

The present specification discloses various systems, apparatus, and methods of formulating photo media for digital press photo printing applications with improved printability and ink or toner adhesion with improved photo feel, and curl control at various environmental conditions at a lower cost of production, and without additional surface treatment.

Some media such as offset type media may be used that produce photo quality images. However, these types of media often require a primer layer before deposition of ink on the media in order to support ink or toner adhesion during a digital printing process. Thus, one disadvantage of these types of media is that it is expensive due to the requirement of additional layers such as the primer layer, and requires one or more additional steps in producing such a media. Further, it is often difficult to control curl in these types of media, and these types of media often require a laminate layer on both sides of the media to control photo media curl. The above disadvantages may cause the cost of production of the photo media to increase.

Thus, one illustrative example of the present system, apparatus, and method, may comprise a laminate layer on an image receiving side of a photo media to provide a final finish such as a glossy or matte finish, image durability, and image permanence. Further, in one example, a non-image receiving side layer of substrate includes an extruded barrier layer to control curl and provide a photo feel to a consumer that is comparable to traditional silver halide photo papers. In one example, the barrier layer may comprise an extruded polyethylene (PE) layer, an extruded polypropylene (PP) layer, or an extruded polyester layer, among other types of extruded layers. Further, the image receiving side laminate layer and non-image receiving side barrier layer may be balanced to ensure that the photo media does not curl at various environmental conditions that a consumer or photo service would use the photo media. This may be performed by controlling the coat weight ratio between the image receiving side laminate layer and non-image receiving side barrier layer. Further, aspects of the present disclosure eliminate the need for a primer layer within the photo media through the design of an image receiving coating or top coat layer, and pre-coat layer. In one example, the image receiving coating or top coat provides for improved printability and ink or toner adhesion.

In another illustrative example, an image receiving coating or top coat layer may be placed between the substrate and laminate layer on the image receiving side of the photo media. The top coat may comprise non-film forming polymers from one of the following polymer groups: styrene, acrylic, styrene/acrylics, vinyl/acetate, poly acrylics, methacrylates or combinations thereof. The glass transition temperature (Tg) for these non-film forming polymers is greater than approximately 50° C. In another example, the Tg of these non-film forming polymers is greater than approximately 75° C. In yet another example, the Tg of these non-film forming polymers is greater than approximately 100° C. Specific examples of these polymers may include, for example, a styrene acrylic emulsion polymer sold under the trade name RAYCAT® 29033, a polyacrylic emulsion polymer sold under the trade name RAYCAT® 78, and an acrylic emulsion polymer sold under the trade name RAYCRYL® 30S available from Specialty Polymers, Inc. These polymers improve printability and ink or toner adhesion. Further, the top coat may comprise pigments such as, for example, relatively small particles of a clay, a synthetic clay, precipitated calcium carbonate (PCC), titanium dioxide ($TiO_2$), plastic pigments such as, for example, DOW HS 3020 NA available from Dow Corning Co. (DOW), or combinations thereof. Further, the top coat may include water dispersible binders such as Acronal S504, Acronal S728, Raycryl 48083, water soluble binders such as polyvinyl alcohol (PVA), starch, and other functional additives such as slip aids and defoamers, among others.

In another illustrative example, a pre-coat may be placed between the top coat and the substrate on the image receiving side of the photo media. In yet another example, the pre-coat may be placed between the substrate and the barrier layer on the non-image receiving side of the photo media. The pre-coat may comprise pigments such as ground calcium carbonate (GCC), precipitated calcium carbonate (PCC), clay, and combinations thereof. Further, the pre-coat may include water dispersible binders such as Acronal S504, Acronal S728, Raycryl 48083, water soluble binders such as polyvinyl alcohol (PVA), starch, and other functional additives such as slip aids and defoamers, among others.

As used in the present specification and in the appended claims, the term "photo media" or "photographic media" is meant to be understood broadly as any one of various sizes of printing paper upon which an image may be transferred and with which is used for making photographic prints of an image. The photo media may include a base substrate and any number of layers of materials disposed on the base substrate including laminates and resins, among others. Examples of photo media may include a silver halide based photo media, a fiber based photo media, and a resin coated base paper, among others.

As used in the present specification and in the appended claims, the term "non-film forming polymers" may include any polymer from one of the following polymer groups: styrene, acrylic, styrene/acrylics, vinyl/acetate, poly acrylics, methacrylates, or combinations thereof. The glass transition temperature (Tg) for these non-film forming polymers is greater than approximately 50° C. In another example, the Tg of these non-film forming polymers is greater than approximately 75° C. In yet another example, the Tg of these non-film forming polymers is greater than approximately 100° C. Some examples of non-film forming polymers may include, for example, a styrene acrylic emulsion polymer sold under the trade name RAYCAT® 29033, a polyacrylic emulsion polymer sold under the trade name RAYCAT® 78, and an acrylic emulsion polymer sold under the trade name RAYCRYL® 30S available from Specialty Polymers, Inc., and a glycol ether free acrylic emulsion sold under the trade name JONCRYL® ECO 2189 available from Baden Aniline and Soda Factory (BASF).

Further, used in the present specification and in the appended claims, the term "curl" is meant to be understood broadly as any distortion or warping of a photo media brought about by any process performed on the photo media during the construction of the photo media or during post-construction processes such as printing and finishing. Curl may be an effect of differential dimensional changes between layers in the photo media that may be caused by, for example, different moisture or thermal expansions between respective layers of the media, and the release of differing amounts of internal strain, among other effects.

As used herein and in the appended claims the terms "image receiving coating" or "top coat" are meant to be understood broadly as any coating which can receive an ink or toner; any coating comprising light-sensitive chemicals which, when exposed to a light source, may receive an image; any coating comprising heat sensitive chemicals which, when exposed to heat, may receive an image; or any combination thereof. Throughout the various illustrative examples of the present application, for purposes of simplicity the image receiving coating may receive an image from an printing device such as, for example, an INDIGO® WS6000P Digital Printing Press or a T300 Digital Web Press, both available from Hewlett-Packard Company (Palo Alto, Calif., USA).

Additionally, as used herein and in the appended claims, the "image receiving side" is meant to be understood broadly as any side of a sheet of photo paper meant to receive an image. Likewise, as used herein and in the appended claims, the "non-image receiving side" is meant to be understood broadly as any side of a sheet of photo paper not meant to receive an image.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples. The various instances of the phrase "in one example" or similar phrases in various places in the specification are not necessarily all referring to the same example.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

FIG. 1 is a block diagram illustrating a photographic processing system (100). In one example, the photographic processing system (100) may include a printer (105), such as an electro-photographic printer. In one example, the printer (105) may be an INDIGO® digital printing press available from Hewlett-Packard Company (Palo Alto, Calif., USA). INDIGO® digital printing presses are a series of digital printing presses manufactured by the Hewlett-Packard Company (HP) in Ness Ziona, Israel. HP Indigo presses are used for general commercial printing, direct mail, photo, publications, labels, flexible packaging, folding cartons, and specialty printing. The INDIGO® press's ability to print without films and plates enables it to create personalized short runs, while changing text, images, and jobs without having to stop the press. HP INDIGO® digital printing presses are also well-suited to consumer-generated web-to-print applications ranging from business cards to photobooks.

With a six color INDIGO® digital printing press such as, for example, model number WS6000P, a user is able to produce photo quality prints comparable to silver halide photo prints. The commercially available papers such as offset type media includes additional surface treatment (primer layer) and processing to address inadequate ink or toner adhesion and print uniformity issues. Further, curl control is difficult in offset type of media, and, as a result, these types of media require a laminate layer on both sides of the media. The photo media disclosed below eliminates these disadvantages within the media.

The printer (105) may receive digital image data from, for example, a scanner (115), or other auxiliary computing device. In another example, the printer (105) may receive digital image data from a computing device (120). Examples of a computing device may include a laptop computer, a personal digital assistant (PDA), a digital camera, or a mobile phone such as a smart phone, among others. In yet another example, the printer (105) may receive digital image data from a removable storage media (125) communicatively coupled to the printer (105). Examples of a removable storage media (125) may include flash memory cards, a digital camera, floppy disks, compact discs, or Universal Serial Bus (USB) drives, among others. In still another example, the printer (105) may receive digital image data from a remote computing device (145) in which the digital image date is received from the remote device (145) by the printer via a network (140) such as, for example, the Internet. Examples of a remote device (145) may include a client computer or an internet enabled smart phone, among others.

In one example, the printer (105) prints images corresponding to the image data on a photographic media (130). The photographic media (130) may be supplied to the printer (105) by a media feeder (135). The photographic media (130) may include, for example, a base substrate and any number of additional layers of materials as is discussed in more detail below. The photographic media (130) may consist of various weights. In one example, the photographic media (130) may be in the form of a continuous sheet (or web) disposed on a roller. In another example, the photographic media (130) may be in the form of discrete sheets of print media. In this example, the discrete sheets of print media may be of various sizes including, for example, 12 in. by 18 in., or larger sizes. In yet another example, the photographic media (130) may be a media for photo printing that may be subjected to a post-imaging lamination process.

After the images are printed on the photographic media (130), a laminate layer may be disposed on the photographic media. In this manner, the laminate layer may provide a final photo finish such as a glossy or matte finish. Further, the laminate layer may provide image durability and image permanence to the photographic media (130) with what a consumer may consider is a true look and feel of photographic paper.

Figure 2:
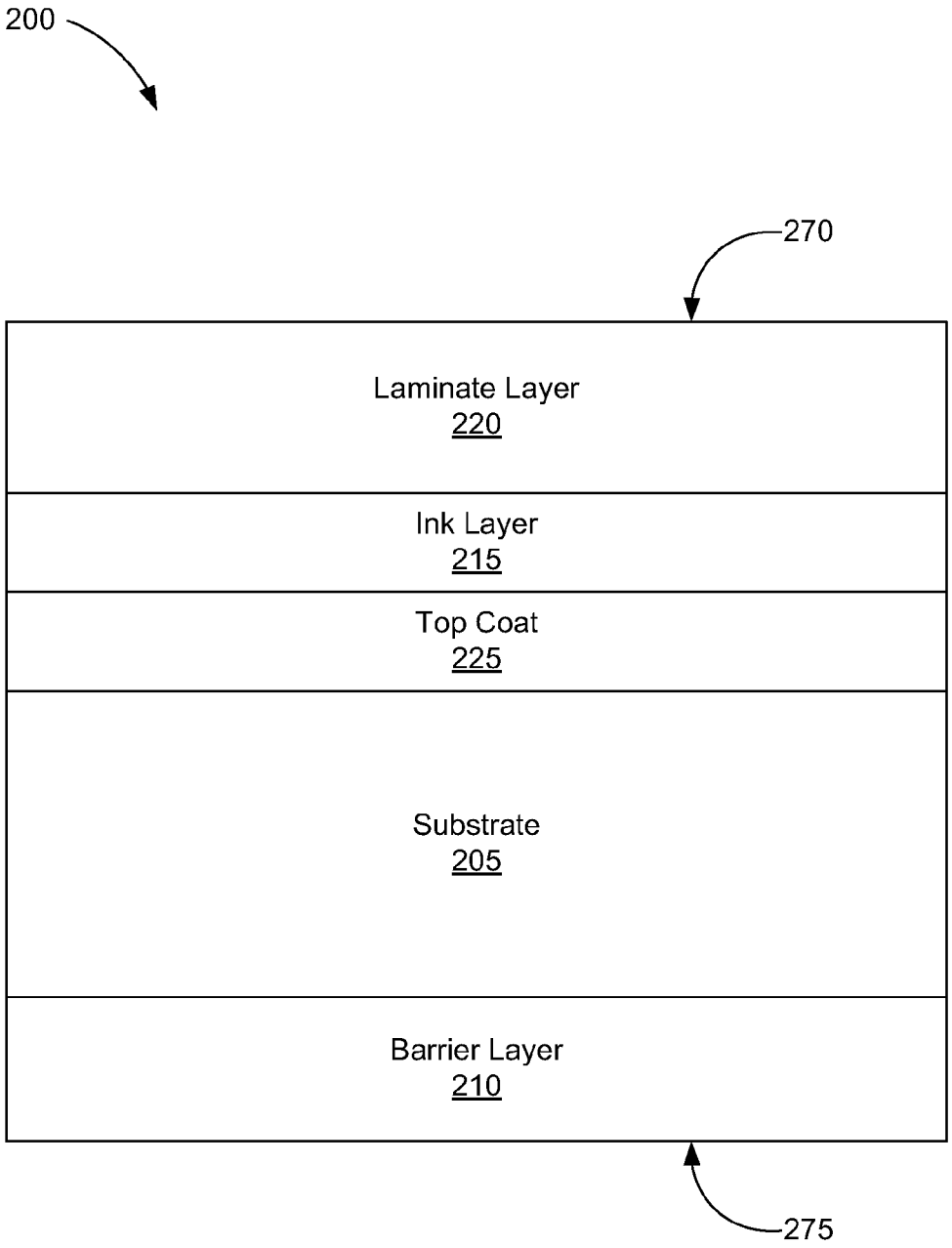
FIG. 2 is a cross-sectional diagram of an illustrative sheet of photo media, according to one example of principles described herein.
Figure 3:
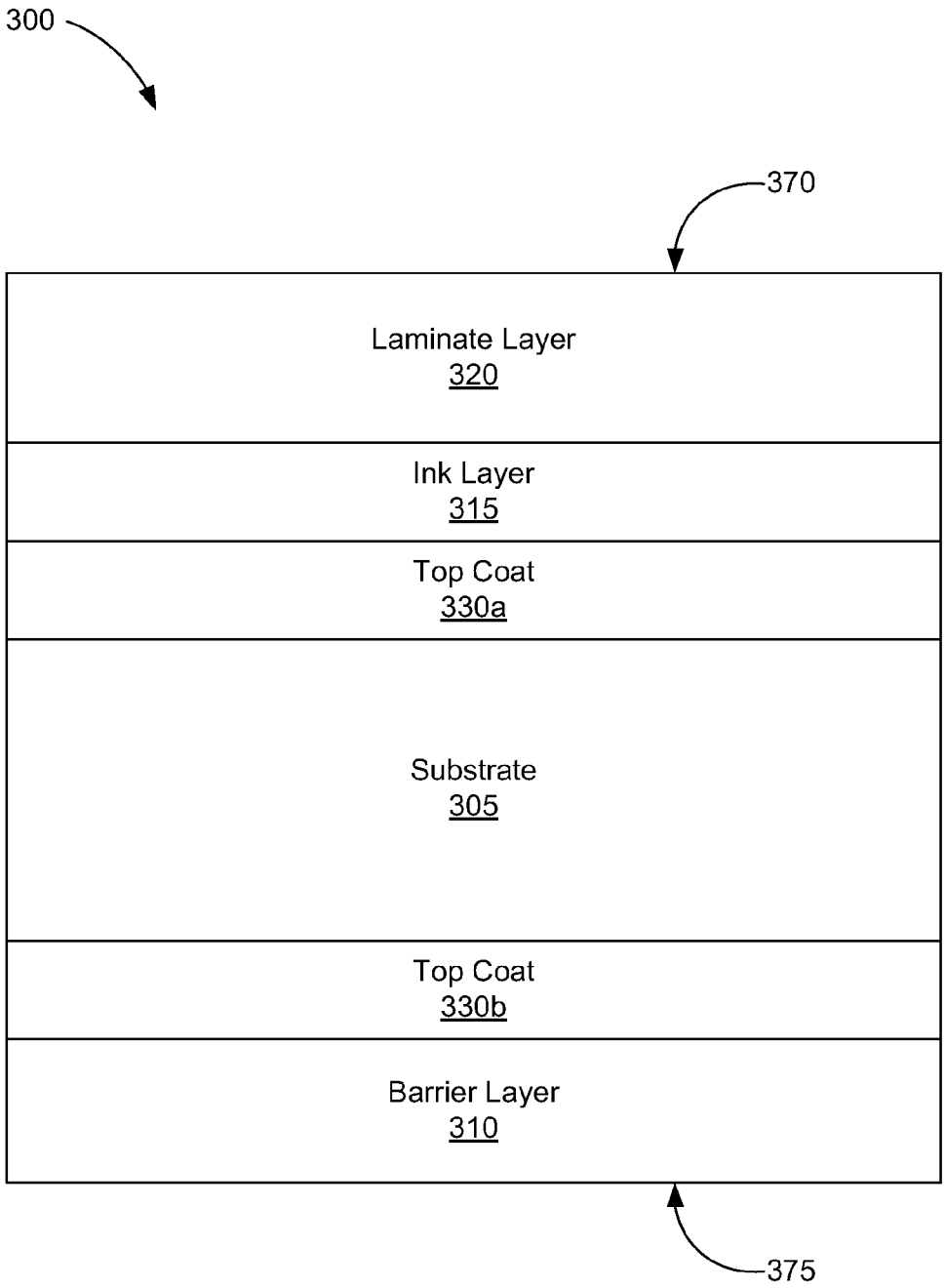
FIG. 3 is a cross-sectional diagram of an illustrative sheet of photo media, according to another example of principles described herein.
Figure 4:
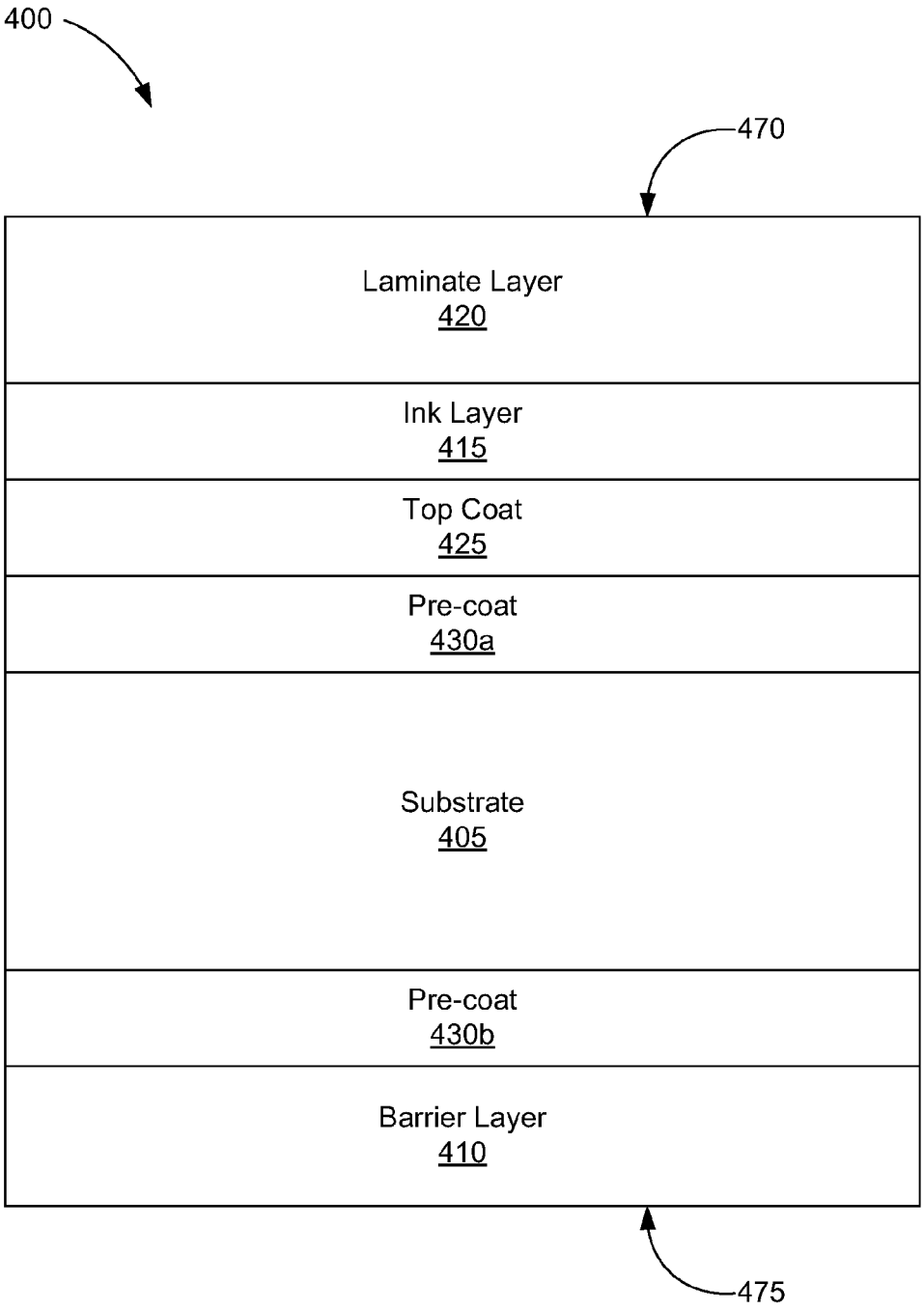
FIG. 4 is a cross-sectional diagram of an illustrative sheet of photo media, according to another example of principles described herein.
Figure 5:
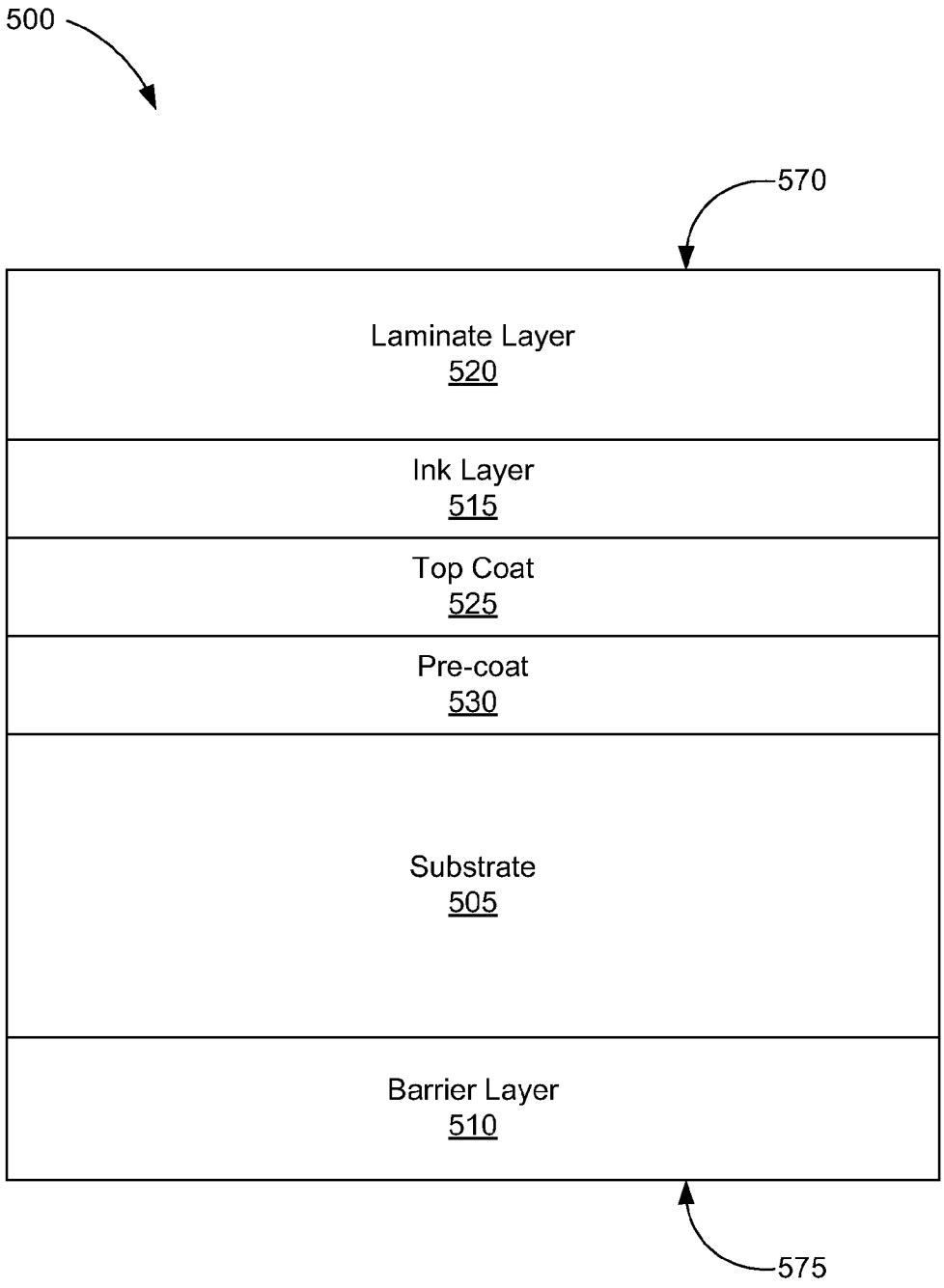
FIG. 5 is a cross-sectional diagram of an illustrative sheet of photo media, according to another example of principles described herein.

Turning now to FIG. 2, a cross-sectional diagram of an illustrative sheet of photo media (200) is shown. In FIG. 2 and throughout the drawings, sizes or thicknesses of various layers of print media may not be shown to scale with respect to actual sizes and thicknesses. First, the photo media (200) may include a substrate (205) upon which a number of additional layers may be disposed. Generally, throughout the examples herein, the substrate (FIGS. 2-5, 205, 305, 405, 505) may be made of any type of material that may be suitable for layering a number of coatings or layers thereon including, but in no way limited to, virgin hardwood fibers, virgin softwood fibers, virgin non-wood fibers, recycled wood and non-wood fibers, as well as other acceptable types of wood and non-wood pulps, among others. For example, the substrate (FIGS. 2-5, 205, 305, 405, 505) may be suitable for layering a pre-coat (FIG. 4, 430*a*, 430*b*; FIG. 5, 530), a top coat (FIG. 2, 225; FIG. 3, 330*a*, 330*b*; FIG. 4, 425; FIG. 5, 525), a laminate layer (FIGS. 2-5, 220, 320, 420, 520), a barrier layer (FIGS. 2-5, 210, 310, 410, 510), and combinations of these, on the substrate (FIGS. 2-5, 205, 305, 405, 505). Further, the substrate (FIGS. 2-5, 205, 305, 405, 505) may or may not include a filler such as a ground calcium carbonate such as that sold under the trade name of HYDROCARB® 60 available from Omya, Inc., precipitated calcium carbonate such as that sold under the trade name of OPACARB® A40 or OPACARB® 3000 available from Specialty Minerals Inc. (SMI), clay such as MIRAGLOSS® available from Engelhard Corporation, and titanium dioxide (TiO2) available from, for example, SIGMA-ALDRICH Co.

Further, in one example, the substrate (FIGS. 2-5, 205, 305, 405, 505) may or may not be calendared (either inline or offline). The substrate (FIGS. 2-5, 205, 305, 405, 505) may have a basis weight between 130 and 300 gsm (grams per square meter). In another example, the substrate (FIGS. 2-5, 205, 305, 405, 505) may have a basis weight between 150 and 250 gsm.

Therefore, the material with which the substrate (FIGS. 2-5, 205, 305, 405, 505) is made of may be resilient enough to both support the various coatings used in the illustrative examples as well as be able to withstand the mechanical stresses associated with the printing process. The substrate (FIGS. 2-5, 205, 305, 405, 505) may be made of any type of material including, but in no way limited to, virgin hardwood fibers, virgin softwood fibers, virgin non-wood fibers, recycled wood and non-wood fibers, as well as other acceptable types of wood and non-wood pulps, among others. Additionally, the thickness of the substrate (FIGS. 2-5, 205, 305, 405, 505) may vary according to the purpose with which the photo paper will be used.

In one example, the surface roughness of the coated photo media after the image receiving layer has been applied (FIGS. 2-5, 225, 330*a*, 425, 525) and prior to ink layer deposited (215, 315, 415, 515) may be less than 1.5 micrometers (μm) (as measured by a Parker Print Surf (PPS) microprocessor-controlled instrument that performs high speed, precision measurements of paper surface roughness). The surface strength of the coated photo media after the image receiving layer has been applied (FIGS. 2-5, 225, 330*a*, 425, 525) may include a wax strength number of, for example, between 8 and 15 using, for example, Dennison standard test waxes. The Dennison wax test is a test performed to measure a substrate's surface strength, in which calibrated, progressively adhesive wax sticks are melted onto the surface of a paper sample and, after cooling, pulled quickly from the surface. The "wax strength number" is the highest-number wax stick that can be melted on and pulled from the paper without marring its surface. In another embodiment, the surface strength of the coated photo media after the image receiving layer has been applied (FIGS. 2-5, 225, 330*a*, 425, 525) may include a wax strength number greater than 12.

Turning again to FIG. 2, in one example, an ink layer (215) may be disposed on an image receiving layer (225) of the photo media (200). The ink layer (215) may be printed or otherwise disposed on the image receiving layer (225) during a printing process as is described in more detail below. In one example, the photo media (200) may further include a barrier layer (210), an ink layer (215), and a laminate layer (220) according to the principles described herein. The photo media (200) may also include a top coat (225). The top coat (225) serves as an image receiving layer with improved printability and ink or toner adhesion with respect to the ink layer (215). The top coat (225) also serves to assist in the lamination process in connection with the laminate layer (220).

In one example, the top coat (225) may consist of 50 to 90% pigments and non-film forming polymers by weight relative to the total composition. In another example, the top coat may consist of 60 to 80% pigments and non-film forming polymers. Of these, the weight ratio of the non-film forming polymers to pigments in the top coat (225) is between 1:9 to 1:1. In another example, the weight ratio of the non-film forming synthetic polymers to pigments in the top coat (225) is between 1:5 to 1:2. In one example, the glass transition temperature (Tg) for these non-film forming polymers is greater than approximately 50° C. In another example, the Tg of the non-film forming polymers is greater than approximately 75° C. In yet another example, the Tg of these non-film forming polymers is greater than approximately 100° C. The non-film forming synthetic polymers may include, for example, a styrene acrylic emulsion polymer sold under the trade name RAYCAT® 29033, a polyacrylic emulsion polymer sold under the trade name RAYCAT® 78, and an acrylic emulsion polymer sold under the trade name RAYCRYL® 30S available from Specialty Polymers, Inc., a glycol ether free acrylic emulsion sold under the trade name JONCRYL® ECO 2189 available from Baden Aniline and Soda Factory (BASF), and combinations thereof.

Further, with regard to the pigments, the top coat (225) may include, for example, ground calcium carbonate such as that sold under the trade name of HYDROCARB® 60 available from Omya, Inc., precipitated calcium carbonate such as that sold under the trade name of OPACARB® A40 or OPACARB® 3000 available from Specialty Minerals Inc. (SMI), clay such as MIRAGLOSS® available from Engelhard Corporation, a synthetic clay such as hydrous sodium lithium magnesium silicate for example LAPONITE® available from Southern Clay Products, Inc., titanium dioxide (TiO2) available from, for example, SIGMA-ALDRICH Co, and plastic pigments such as, for example, DOW HS 3020 NA available from Dow Corning Co. (DOW)

Still further, the top coat (225) may contain 10 to 40% water dispersible binders and up to 10% water soluble binders by weight relative to the total composition. Examples of water dispersible binders may include, for example, an acrylic polymer in water sold under the trade name RAYCRYL® 48083 available from Specialty Polymers, an aqueous dispersion of an n-butyl acrylate-acrylonitrile-styrene copolymer commercially available under the trade name ACRONAL® S 504 available from Baden Aniline and Soda Factory (BASF), and a styrene/n-butyl acrylate copolymer commercially available under the trade name ACRONAL® S 728 available from Baden Aniline and Soda Factory (BASF). Examples of water soluble binders may include, for example, a combination of polyvinyl alcohol with methanol sold under the trade name MOWIOL® 40-88 available from Kuraray America, Inc., and 2-hydroxyethyl starch ether sold under the trade name of PENFORD® Gum 280 available from Penford Products Co.

The top coat (225) may further contain any number of additives including slip aid such as Michem® Emulsion 29235 available from Michelman Inc., optical brighteners such as a tetrasulfonated stilbene compound commercially available under the designation Tinopal ABP-A from Chemische Industrie Basel (Ciba), and colorants or dyes such as that sold under the trade name IRGALITE® Blue Dye by Chemische Industrie Basel (Ciba). Further, the top coat (225) may contain lubricants, dyes and colorants, thickeners, biocides, defoamers, and surfactants.

In one example, the top coat (225) may have a coat weight between 5 and 20 gsm. In another example, the top coat (225) may have a coat weight between 10 to 15 gsm.

The photo media (200) may also include a barrier layer (210) disposed on the substrate (205) on the non-image receiving side (275). In one example, the barrier layer (210) may comprise an extruded layer of material that may serve several purposes including a moisture barrier. Further, the barrier layer (210) may also serve as a curl balance coating in conjunction with the laminate layer (220) as is discussed in more detail below. Still further, the barrier layer (210) may also provide to a consumer with a product that has a true feel of photo media.

Further, the chemical composition of the barrier layer (210) may comprise, for example, a low density polyethylene (PE), a high density polyethylene (PE), polypropylene (PP), and polyethylene terephthalate (PET), among others. One advantage of an extruded polymer layer like the barrier layer (210) is that an extruded polymer layer is less costly than an equivalent performing lamination layer. Further, as disclosed above, an extruded polymer layer like the barrier layer (210) may be balanced with the laminate layer (220) to reduce or eliminate curling of the photo media (200) that may occur during and after deposition of the laminate layer (220).

The photo media (200) may also include a laminate layer (220) disposed on the ink layer (215) on the image receiving side (270). The laminate layer (220) may be disposed on the photo media (200) after an ink layer (215) has been printed or otherwise disposed on the photo media (200) during, for example, a printing process. Thus, in this example, the laminate layer (220) may be a post-imaging layer, and the photographic processing system (100) of FIG. 1 may apply the laminate layer (220) after printing. The laminate layer (220) serves to provide a final finish to the photo media such as a high gloss, semi-gloss, luster, or matte finish. In one example, the laminate layer comprises a polyester, polypropylene (PP), or nylon, among others.

As mentioned above, the coat weight ratio of barrier layer (210) to laminate layer (220) may be controlled in order to achieve acceptable curl performance across environmental conditions. In one example, in order to improve curl and balance the barrier layer (210) and the laminate layer (220), the coat weight ratio of barrier layer (210) applied to the non-image receiving side (275) of the photo media (200) with respect to the laminate layer (220) applied to the image receiving side (270) of the photo media (200) may be between 1:1 and 3:1. In another example, the coat weight ratio of the barrier layer (210) to the laminate layer (220) may be 1.5:1. In yet another example, the coat weight ratio of the barrier layer (210) to the laminate layer (220) may be 1.25:1. Thus, in this manner, curling of the photo media (200) may be reduced or eliminated across all environmental conditions including different relative humilities and temperatures.

Before moving to additional figures, it may be noted that aspects and properties of the various examples of the photo media (200) of FIG. 2 may apply to the examples disclosed in FIGS. 3-5 as well. For example, the substrate (200), barrier layer (210), ink layer (215), laminate layer, (220), and image receiving layer or top coat (225) of FIG. 2 may be identical or similar to corresponding elements in other examples.

FIG. 3 is a cross-sectional diagram of an illustrative sheet of photo media (300), according to another example. In one example, the photo media (300) may include a substrate (305), a barrier layer (310), an ink layer (315), and a laminate layer (320) according to the principles described herein. The photo media (300) may also include an image receiving layer or top coat (330*a*) disposed on the image receiving side (370) of the photo media (300) as well as a top coat (330*b*) disposed on the non-image receiving side (375) of the photo media (300). The top coat (330*a*) serves as an image receiving layer with improved printability and ink or toner adhesion with respect to the ink layer (315). The top coat (330*a*) also serves to assist in the lamination process in connection with the laminate layer (320). Further, the layers of top coat (330*a*, 330*b*) serve to improve surface smoothness of the photo media (300). Still further, the second layer of top coat (330*b*) may assist in balancing the photo media (300) or serves as a second image receiving layer with improved printability and ink or toner adhesion with respect to the second ink layer to produce a two side printed photo media In one example, the top coat (330*a*, 330*b*) may have a coat weight between 5 and 20 gsm. In another example, the top coat (330*a*, 330*b*) may have a coat weight between 10 to 15 gsm.

FIG. 4 is a cross-sectional diagram of an illustrative sheet of photo media (400), according to another example. In one example, the photo media (400) may include a substrate (405), a barrier layer (410), an ink layer (415), and a laminate layer (420) according to the principles described herein. The photo media (400) may also include a pre-coat (430*a*) disposed on the image receiving side (470) and on top of the substrate (405) as well as a top coat (425) disposed on the image receiving side (470) on top of the pre-coat (430*a*). Further, a second layer of pre-coat (430*b*) may be disposed on the non-image receiving side (475) of the photo media (400) between the substrate (405) and the barrier layer (410). The top coat (425) serves a as image receiving layer with improved printability and ink or toner adhesion with respect to the ink layer (415). The top coat (425) also serves to assist in the lamination process in connection with the laminate layer (420). Further, the layer of pre-coat (430*a*) in addition to the top coat (425) serves to improve image receiving layer (425) surface smoothness of the photo media (400). In one example, the top coat (425) may have a coat weight between 5 and 20 gsm. In another example, the top coat (425) may have a coat weight between 10 to 15 gsm. Still further, the second layer or pre-coat (430*b*) may assist in balancing the curl of the photo media (400).

In one example, the layers of pre-coat (430*a*, 430*b*) consist of 40 to 95% pigments. Further, with regard to the pigments, the layers of pre-coat (430*a*, 430*b*) may include, for example, ground calcium carbonate such as that sold under the trade name of HYDROCARB® 60 available from Omya, Inc., precipitated calcium carbonate such as that sold under the trade name of OPACARB® A40 or OPACARB® 3000 available from Specialty Minerals Inc. (SMI), clay such as MIRAGLOSS® available from Engelhard Corporation, a synthetic clay such as hydrous sodium lithium magnesium silicate for example LAPONITE® available from Southern Clay Products, Inc., and titanium dioxide (TiO2) available from, for example, SIGMA-ALDRICH Co.

Still further, the layers of pre-coat (430*a*, 430*b*) may contain 5 to 40% water dispersible binders and up to 10% water soluble binders. Examples of water dispersible binders may include, for example, an acrylic polymer in water sold under the trade name RAYCRYL® 48083 available from Specialty Polymers, an aqueous dispersion of an n-butyl acrylate-acrylonitrile-styrene copolymer commercially available under the trade name ACRONAL® S 504 available from Baden Aniline and Soda Factory (BASF), a styrene/n-butyl acrylate copolymer ACRONAL® S 728 available from Baden Aniline and Soda Factory (BASF). Examples of water soluble binders may include, for example, a combination of polyvinyl alcohol with methanol sold under the trade name MOWIOL® 40-88 available from Kuraray America, Inc., and 2-hydroxyethyl starch ether sold under the trade name of PENFORD® Gum 280 available from Penford Products Co.

The layers of pre-coat (430*a*, 430*b*) may further contain any number of additives including slip aid such as Michem® Emulsion 29235 available from Michelman Inc., optical brighteners such as a tetrasulfonated stilbene compound commercially available under the designation Tinopal ABP-A from Chemische Industrie Basel (Ciba), and colorants or dyes such as that sold under the trade name IRGALITE® Blue Dye by Chemische Industrie Basel (Ciba). Further, the layers of pre-coat (430*a*, 430*b*) may contain lubricants, dyes and colorants, thickeners, biocides, defoamers, and surfactants.

In one example, the layers of pre-coat (430*a*, 430*b*) may have a coat weight between 5 and 25 gsm. In another example, the layers of pre-coat (430*a*, 430*b*) may have a coat weight between 10 to 20 gsm.

Turning now to FIG. 5 is a cross-sectional diagram of an illustrative sheet of photo media (500), according to another example. In one example, the photo media (500) may include a substrate (505), a barrier layer (510), an ink layer (515), and a laminate layer (520) according to the principles described herein. The photo media (500) may also include a pre-coat (530) disposed on the image receiving side (570) and on top of the substrate (505) as well as a top coat (525) disposed on the image receiving side (570) on top of the pre-coat (530). The top coat (525) serves as image receiving layer with improved printability and ink or toner adhesion with respect to the ink layer (515). The top coat (525) also serves to assist in the lamination process in connection with the laminate layer (520). In one example, the top coat (525) may have a coat weight between 5 and 20 gsm. In another example, the top coat (525) may have a coat weight between 10 to 15 gsm. In one example, the layer of pre-coat (530) in addition to the top coat (525) serves to improve image receiving layer (525) surface smoothness of the photo media (500). In one example, the layers of top coat (525) and pre-coat (530) may have a total coat weight between 10 and 45 gsm. In another example, the layers of top coat (525) and pre-coat (530) may have a total coat weight between 20 to 35 gsm.

Throughout the examples of photo media disclosed in FIGS. 2 through 5, the top coat (225, 330*a*, 330*b*, 425, 525) may comprise various formulations. These various formulations will now be discussed in detail.

In a first example (First Example Top Coat), the top coat (225, 330*a*, 330*b*, 425, 525) may comprise 94 parts (approximately 67.6% by weight) of precipitated calcium carbonate such as that sold under the trade name of OPACARB® A40 or OPACARB® 3000 available from Specialty Minerals Inc. (SMI); 6 parts (approximately 4.3% by weight) of a plastic pigment such as, for example, DOW HS3020 NA available from Dow Corning Co. (DOW); 25 parts (approximately 18.0% by weight) of a synthetic polymer such as, for example, a glycol ether free acrylic emulsion sold under the trade name JONCRYL® ECO 2189 available from Baden Aniline and Soda Factory (BASF); 10 parts (approximately 7.2% by weight) of a water dispersible binder such as, for example, a styrene/n-butyl acrylate copolymer ACRONAL® S 728 available from Baden Aniline and Soda Factory (BASF); 3 parts (approximately 2.2% by weight) of a water soluble binder such as, for example, 2-hydroxyethyl starch ether sold under the trade name of PENFORD® Gum 280 available from Penford Products Co.; and 1 part (approximately 0.72% by weight) of a slip aid such as, for example, Michem® Emulsion 29235 available from Michelman Inc. In this example, the topcoat's coat weight may be approximately 8 gsm. In another example, the topcoat's coat weight may be approximately 12 gsm.

In a second example (Second Example Top Coat), the top coat (225, 330*a*, 330*b*, 425, 525) may comprise 40 parts (approximately 24.4% by weight) of precipitated calcium carbonate such as that sold under the trade name of OPACARB® A40 or OPACARB® 3000 available from Specialty Minerals Inc. (SMI); 54 parts (approximately 33.0% by weight) of a clay such as MIRAGLOSS® available from Engelhard Corporation; 6 parts (approximately 3.7% by weight) of a plastic pigment such as, for example, DOW HS3020 NA available from Dow Corning Co. (DOW); 50 parts (approximately 30.5% by weight) of a synthetic polymer such as, for example, a glycol ether free acrylic emulsion sold under the trade name JONCRYL® ECO 2189 available from Baden Aniline and Soda Factory (BASF); 10 parts (approximately 6.1% by weight) of a water dispersible binder such as, for example, a styrene/n-butyl acrylate copolymer ACRONAL® S 728 available from Baden Aniline and Soda Factory (BASF); 3 parts (approximately 1.8% by weight) of a water soluble binder such as, for example, 2-hydroxyethyl starch ether sold under the trade name of PENFORD® Gum 280 available from Penford Products Co.; and 1 part (approximately 0.61% by weight) of a slip aid such as, for example, Michem® Emulsion 29235 available from Michelman Inc. In this example, the topcoat's coat weight may be approximately 15 gsm.

In a third example (Third Example Top Coat), the top coat (225, 330*a*, 330*b*, 425, 525) may comprise 100 parts (approximately 43.0% by weight) of a synthetic clay such as hydrous sodium lithium magnesium silicate for example LAPONITE® available from Southern Clay Products, Inc.; 10 parts (approximately 4.3% by weight) of a plastic pigment such as, for example, DOW HS3020 NA available from Dow Corning Co. (DOW); 100 parts (approximately 43.0% by weight) of a synthetic polymer such as, for example, a glycol ether free acrylic emulsion sold under the trade name JONCRYL® ECO 2189 available from Baden Aniline and Soda Factory (BASF); 20 parts (approximately 8.6% by weight) of a water dispersible binder such as, for example, a styrene/n-butyl acrylate copolymer ACRONAL® S 728 available from Baden Aniline and Soda Factory (BASF); and 3 parts (approximately 1.3% by weight) of a slip aid such as, for example, Michem® Emulsion 29235 available from Michelman Inc. In this example, the topcoat's coat weight may be approximately 5 gsm.

In a fourth example (Fourth Example Top Coat), the top coat (225, 330*a*, 330*b*, 425, 525) may comprise 100 parts (approximately 73.5% by weight) of precipitated calcium carbonate such as that sold under the trade name of OPACARB® A40 or OPACARB® 3000 available from Specialty Minerals Inc. (SMI); 25 parts (approximately 18.4% by weight) of a synthetic polymer such as, for example, an acrylic emulsion polymer sold under the trade name RAYCRYL® 30S available from Specialty Polymers, Inc.; 10 parts (approximately 7.4% by weight) of a water dispersible binder such as, for example, a styrene/n-butyl acrylate copolymer ACRONAL® S 728 available from Baden Aniline and Soda Factory (BASF); and 1 part (approximately 0.74% by weight) of a slip aid such as, for example, Michem® Emulsion 29235 available from Michelman Inc. In this example, the topcoat's coat weight may be approximately 5 gsm.

In a fifth example (Fifth Example Top Coat), the top coat (225, 330*a*, 330*b*, 425, 525) may comprise 100 parts (approximately 62.1% by weight) of precipitated calcium carbonate such as that sold under the trade name of OPACARB® A40 or OPACARB® 3000 available from Specialty Minerals Inc. (SMI); 50 parts (approximately 31.1% by weight) of a synthetic polymer such as, for example, an acrylic emulsion polymer sold under the trade name RAYCRYL® 30S available from Specialty Polymers, Inc.; 10 parts (approximately 6.2% by weight) of a water dispersible binder such as, for example, a styrene/n-butyl acrylate copolymer ACRONAL® S 728 available from Baden Aniline and Soda Factory (BASF); and 1 part (approximately 0.62% by weight) of a slip aid such as, for example, Michem® Emulsion 29235 available from Michelman Inc. In this example, the topcoat's coat weight may be approximately 5 gsm.

In an sixth example (Sixth Example Top Coat), the top coat (225, 330*a*, 330*b*, 425, 525) may comprise 100 parts (approximately 53.8% by weight) of precipitated calcium carbonate such as that sold under the trade name of OPACARB® A40 or OPACARB® 3000 available from Specialty Minerals Inc. (SMI); 75 parts (approximately 40.3% by weight) of a synthetic polymer such as, for example, an acrylic emulsion polymer sold under the trade name RAYCRYL® 30S available from Specialty Polymers, Inc.; 10 parts (approximately 5.4% by weight) of a water dispersible binder such as, for example, a styrene/n-butyl acrylate copolymer ACRONAL® S 728 available from Baden Aniline and Soda Factory (BASF); and 1 part (approximately 0.54% by weight) of a slip aid such as, for example, Michem® Emulsion 29235 available from Michelman Inc. In this example, the topcoat's coat weight may be approximately 5 gsm.

In a seventh example (Seventh Example Top Coat), the top coat (325, 635, 725) may comprise 100 parts (approximately 47.4% by weight) of precipitated calcium carbonate such as that sold under the trade name of OPACARB® A40 or OPACARB® 3000 available from Specialty Minerals Inc. (SMI); 100 parts (approximately 47.4% by weight) of a synthetic polymer such as, for example, an acrylic emulsion polymer sold under the trade name RAYCRYL® 30S available from Specialty Polymers, Inc.; 10 parts (approximately 4.74% by weight) of a water dispersible binder such as, for example, a styrene/n-butyl acrylate copolymer ACRONAL® S 728 available from Baden Aniline and Soda Factory (BASF); and 1 part (approximately 0.47% by weight) of a slip aid such as, for example, Michem® Emulsion 29235 available from Michelman Inc. In this example, the topcoat's coat weight may be approximately 5 gsm.

Throughout the examples of photo media disclosed in FIGS. 4 and 5, the pre-coat (430*a*, 430*b*, 530) may comprise various formulations. These various formulations will now be discussed in detail.

In a first example (First Example Pre-Coat), the pre-coat (430*a*, 430*b*, 530) may comprise 40 parts (approximately 35.4% by weight) of ground calcium carbonate such as that sold under the trade name of HYDROCARB® 60 available from Omya, Inc.; 60 parts (approximately 53.1% by weight) of a clay such as MIRAGLOSS® available from Engelhard Corporation; 5 parts (approximately 4.3% by weight) of an aqueous dispersion of an n-butyl acrylate-acrylonitrile-styrene copolymer commercially available under the trade name ACRONAL® S 504 available from Baden Aniline and Soda Factory (BASF); and 8 parts (approximately 7.1% by weight) of a water soluble binders such as 2-hydroxyethyl starch ether sold under the trade name of PENFORD® Gum 280 available from Penford Products Co. In this example, the pre-coat's coat weight may be approximately 8 gsm.

In a second example (Second Example Pre-Coat), the pre-coat (430*a*, 430*b*, 530) may comprise 65 parts (approximately 59.1% by weight) of ground calcium carbonate such as that sold under the trade name of HYDROCARB® 60 available from Omya, Inc.; 35 parts (approximately 31.8% by weight) of precipitated calcium carbonate such as that sold under the trade name of OPACARB® A40 or OPACARB® 3000 available from Specialty Minerals Inc. (SMI); 9 parts (approximately 8.2% by weight) of a water dispersible binder such as a styrene/n-butyl acrylate copolymer ACRONAL® S 728 available from Baden Aniline and Soda Factory (BASF); and 1 part (approximately 0.9% by weight) of a water soluble binders such as a combination of polyvinyl alcohol with methanol sold under the trade name MOWIOL® 40-88 available from Kuraray America, Inc. In this example, the pre-coat's coat weight may be approximately 12 gsm.

In a third example (Third Example Pre-Coat), the pre-coat (430*a*, 430*b*, 530) may comprise 65 parts (approximately 58.8% by weight) of precipitated calcium carbonate such as that sold under the trade name of OPACARB® A40 or OPACARB® 3000 available from Specialty Minerals Inc. (SMI); 35 parts (approximately 31.7% by weight) of a clay such as MIRAGLOSS® available from Engelhard Corporation; 10 parts (approximately 9.0% by weight) of a water dispersible binder such as a styrene/n-butyl acrylate copolymer ACRONAL® S 728 available from Baden Aniline and Soda Factory (BASF); 0.5 parts (approximately 0.45% by weight) of an optical brightener such as a tetrasulfonated stilbene compound commercially available under the designation Tinopal ABP-A from Chemische Industrie Basel (Ciba); and 0.005 parts (approximately 0.0045% by weight) of a colorant or dye such as that sold under the trade name IRGALITE® Blue Dye by Chemische Industrie Basel (Ciba). In this example, the pre-coat's coat weight may be approximately 15 gsm.

Throughout the examples of photo media disclosed in FIGS. 2 through 5, different constructions of the pre-coat (430*a*, 430*b*, 530) and top coat (225, 330*a*, 330*b*, 425, 525) may be included. These various constructions may comprise various coat weight (measured in gsm). These various constructions and their coat weight are detailed in Table 1 below:

TABLE 1

| Constructions | Formulations | Coat weight (gsm) |
|---|---|---|
| 1 | First Example Top Coat | 15 |
| 2 | Second Example Top Coat | 15 |
| 3 | Third Example Top Coat | 5 |
| 4 | First Example Pre-Coat plus First Example Top Coat | 8 + 15 = 23 |
| 5 | First Example Pre-Coat plus Second Example Top Coat | 8 + 15 = 23 |
| 6 | First Example Pre-Coat plus Third Example Top Coat | 8 + 5 = 13 |
| 7 | Second Example Pre-coat Plus First Example Topcoat | 12 + 12 |
| 8 | Fourth Example Top Coat | 5 |
| 9 | Third Example Pre-Coat plus Fourth Example Top Coat | 15 + 5 = 20 |
| 10 | Third Example Pre-Coat plus Fifth Example Top Coat | 15 + 5 = 20 |
| 11 | Third Example Pre-Coat plus Sixth Example Top Coat | 15 + 5 = 20 |
| 12 | Third Example Pre-Coat plus Seventh Example Top Coat | 15 + 5 = 20 |

The various formulations of coatings disclosed in the photo media of FIGS. 2 through 5 provide for a reduction or elimination of curling that may otherwise occur. For example, as discussed above, the barrier layer and laminate layer may be balanced to ensure curling is reduced or eliminated in the final product. For example, curl data regarding the example photo media of FIG. 5 is detailed in Table 2 below, and is charted in FIG. 7. In this example, the coat weight ratio of barrier layer (510) to the laminate layer (520) is 1.25:1.

TABLE 2

| | Environmental Conditions | | | | |
|---|---|---|---|---|---|
| Constructions | 23° C. 50% RH | 32° C. 20% RH | 30° C. 80% RH | 15° C. 20% RH | 15° C./ 80% RH |
| Photo media (500) shown in FIG. 5 | −5.0 | −6.8 | −2.5 | −8.0 | −3.5 |
| offset paper 1 | +5.8 | −3.3 | +31.5 | −3.5 | +35.3 |
| offset paper 2 | +9.0 | −2.5 | +49.3 | −3.5 | +52.3 |
| Lower Acceptance Limit | −10 | −10 | −10 | −10 | −10 |
| Higher Acceptance Limit | +10 | +10 | +10 | +10 | +10 |

Figure 7:
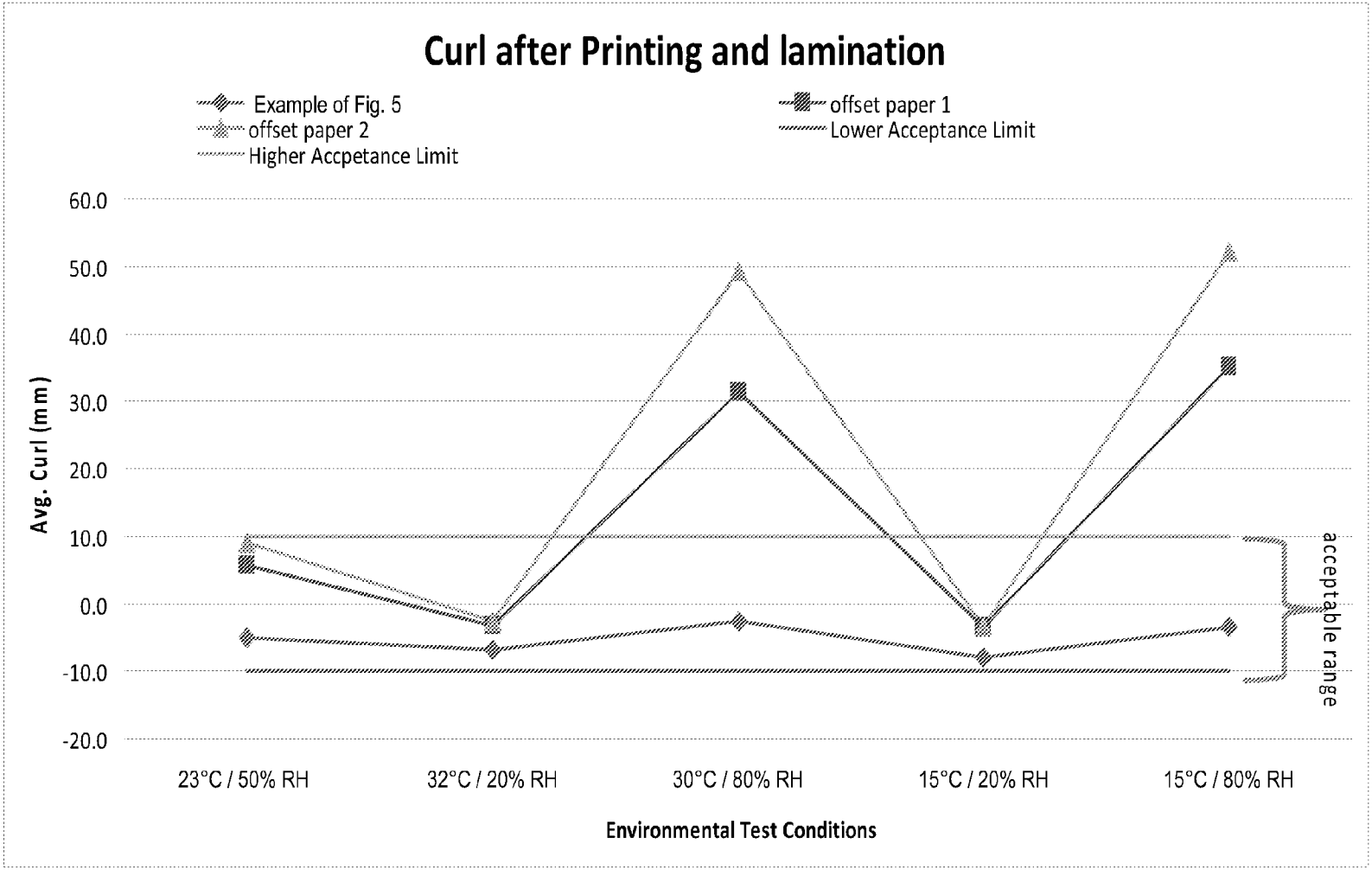
FIG. 7 is a chart depicting illustrative curl data after printing and lamination of a sheet of photo media, according to one example of principles described herein.

As can be seen in Table 2 and the chart of FIG. 7, an acceptable range of curl (measured in millimeters) may include between −10 and +10 mm. The example disclosed above in FIG. 5 comprises a substrate (505), a barrier layer (510) disposed on the non-image receiving side (575) of the photo media (500), a pre-coat (530) disposed on the image receiving side (570) of the photo media (500) on top of the substrate (505), a top coat (525) disposed on the image receiving side (570) of the photo media (500) on top of the pre-coat (530), an ink layer disposed on the image receiving side (570) of the photo media (500) on top of the top coat (525), and a laminate layer disposed on the image receiving side (570) of the photo media (500) on top of the ink layer (515). As depicted in FIG. 7, the photo media (500) of FIG. 5 exhibits a superior curl performance across all environmental conditions tested, while other commercial offset available papers showed significant curl tendency especially at high humidity conditions.

Figure 6:
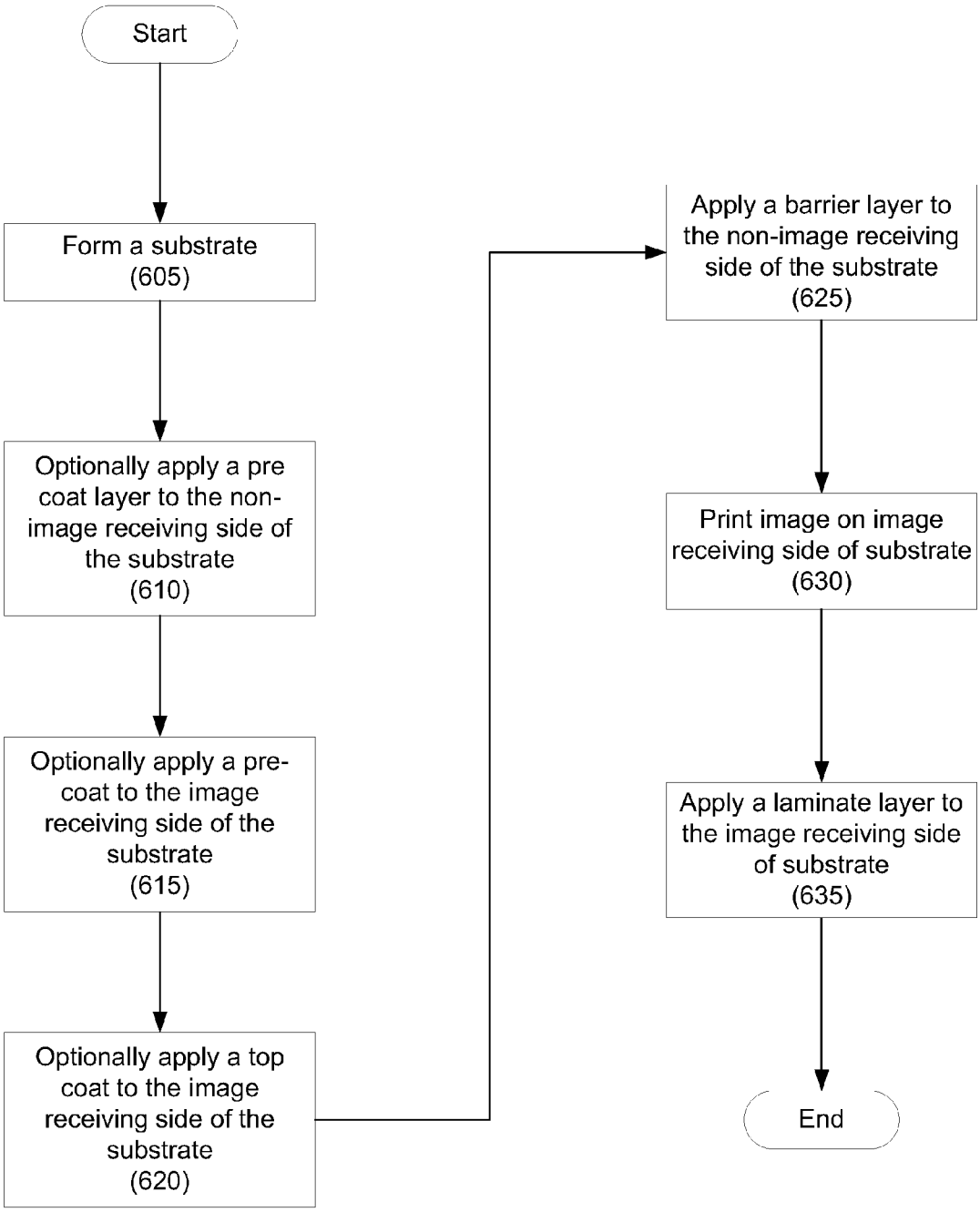
FIG. 6 is a flow chart of an illustrative method of forming a sheet of photo media, according to one example of principles described herein.

Turning now to FIG. 6, a flow chart of an illustrative method of forming a sheet of photo media is shown. In one example, the method may begin by forming or otherwise making a substrate (605). Next, a pre-coat may be disposed on the non-image receiving side of the substrate (610). This may be performed optionally since, in some examples, a pre-coat is not provided on the non-image receiving side of the photo media.

Then, a pre-coat may be disposed on the image receiving side of the substrate (615). This also may be performed optionally since, in some examples, a pre-coat is not provided on the image receiving side of the photo media. Next, a top coat may be disposed on the image receiving side of the photo media. This too may be performed optionally since, in some examples, a top coat is not provided on the image receiving side of the photo media.

Next, a barrier layer may be disposed in the non-image receiving side of the substrate (625). This may be done by, for example extruding the barrier layer onto the non-image receiving side of the photo media. In one example, a melt extrusion process may be used to dispose the barrier layer. Then, after a barrier layer is disposed in the non-image receiving side of the substrate (625), a printing device may then print an image on the image receiving side of the substrate (630). In one example, the photo media may include a substrate, a number of pre-coats, a top coat, and a barrier layer at the time of printing. Then, after an image has been printed on an image receiving side of the photo media, a laminate layer may be disposed on the image receiving side of the photo media (635) in order to improve the gloss and luster of the photo media. In other words, the method of FIG. 6 may be a post-imaging lamination process where one or more additional layers of coating such as the laminate layer are disposed on the photo media after printing of an image on the photo media takes place.

In one example, the photographic processing system (100) may apply the barrier layer (625) and the laminate layer (635) at a ratio sufficient to reduce or eliminate curling that may occur within the photo media. In one example, in order to balance the barrier layer and the laminate layer, the photographic processing system (100) may apply a coat weight ratio of barrier layer applied to the non-image receiving side of the photo media with respect to the laminate layer applied to the image receiving side of the photo media between 1:1 and 3:1. In another example, the coat weight ratio of barrier layer to laminate layer may be 1.5:1. Thus, in this manner, curling of the photo media may be reduced or eliminated across all environmental conditions.

In one example, the surface roughness of the photo media (200, 300, 400, 500) prior to application of ink layer (215, 315, 415, 515) may be less than 1.5 micrometers (μm) (as measured by a Parker Print Surf (PPS) microprocessor-controlled instrument that performs high speed, precision measurements of paper surface roughness). Further, aspects and properties of the various elements of the photo media (200, 300, 400, 500) of FIGS. 2-5 individually may equally apply to the elements of any of the FIGS. 2-5 as well.

The specification and figures describe a photo media comprising a substrate, the substrate having a first side and a second side, a laminate layer disposed on the first side of the substrate, and an extruded barrier layer disposed on the second side of the substrate. The photo media may further comprise a top coat and a number of pre-coats. The various examples of photo media disclosed herein may have a number of advantages for digital press photo printing such as improved printability and ink or toner adhesion without additional surface treatment, improved photo feel, and better curl control at various environmental conditions at a lower cost of production The preceding description has been presented only to illustrate and describe examples of the principles described. This description is not intended to be exhaustive or to limit these principles to any precise form disclosed. Many modifications and variations are possible in light of the above teaching.

What is claimed is:

1. A photo media comprising:

a substrate, the substrate having an image receiving side and a non-image receiving side;

an extruded barrier layer disposed on the non-image receiving side of the substrate; and an image receiving layer disposed on the image receiving side of the substrate, the image receiving layer being ink printable;

a laminate layer disposed on the image receiving side of the substrate after an ink is printed on the image receiving layer, in which the image receiving layer comprises 50% to 90% pigments and non-film forming polymers, 10% to 40% water dispersible binders, and up to 10% water soluble binders relative to total weight of the composition.

2. The photo media of claim 1, in which the coat weight ratio of barrier layer to the laminate layer is between 1:1 and 3:1.

3. The photo media of claim 1, in which in which the coat weight ratio of barrier layer to the laminate layer is 1.5:1.

4. The photo media of claim 1, in which the non-film forming polymers comprise a styrene, an acrylic, a styrene/acrylic, a vinyl/acetate, a poly acrylic, a methacrylate, or combinations thereof.

5. The photo media of claim 1, in which the non-film forming polymer has a glass transition temperature (Tg) greater than 50° C.

6. The photo media of claim 1, in which the ratio between non-film forming polymer to the pigment is between 1:9 to 1:1 by weight.

7. The photo media of claim 1, further comprising a pre-coat layer disposed on at least the image receiving side of the substrate between the substrate and the image receiving layer, in which the pre-coat comprises 40 to 95% pigments, 5% to 40% water dispersible binders, and up to 10% water soluble binders.

8. The photo media of claim 1, in which the photo media has a surface roughness of less than 1.5 micrometers (μm) as measured by the Parker Print Surf (PPS) method without the ink layer and the laminate layer.

9. A photo media comprising:

a substrate, the substrate comprising an image receiving side and a non-image receiving side;

a pre-coat layer disposed on the image receiving side of the substrate;

a top coat disposed on the image receiving side of the substrate on the pre-coat layer;

a barrier layer disposed on the non-image receiving side of the substrate; and a laminate layer disposed on the image receiving side of the substrate after an ink layer is printed on the top coat wherein the top coat layer comprises 50% to 90% pigments and non-film forming polymers, 10% to 40% water dispersible binders, and up to 10% water soluble binders relative to total weight of the composition.

10. The photo media of claim 9, in which the pre-coat comprises 40 to 95% pigments, 5% to 40% water dispersible binders, and up to 10% water soluble binders.

11. A method of forming a photo media comprising:

depositing a pre-coat layer on a non-image receiving side of a substrate;

depositing a barrier layer on the non-image receiving side of the substrate;

depositing an image receiving layer on an image receiving side of the substrate printing an image on the image receiving side of the substrate; and applying a laminate layer to the image receiving side of the substrate, wherein the image receiving layer comprises 50% to 90% pigments and non-film forming polymers, 10% to 40% water dispersible binders, and up to 10% water soluble binders relative to total weight of the composition.

12. The method of claim 11, further comprising:

depositing a number of pre-coat layers on the substrate on the image receiving side of the substrate; and depositing a top coat on the image receiving side of the substrate between the per-coat layers and before printing the image on the image receiving side of the substrate.

13. The method of claim 11, in which the barrier layer is extruded onto the non-image receiving side of the substrate.

14. The photo media of claim 9, further comprising depositing a number of the pre-coat layers on the non-image receiving side of the substrate between the substrate and the barrier layer.

15. The photo media of claim 9, further comprising depositing a number of the top coat layers on the non-image receiving side of the substrate between the substrate and the barrier layer.

16. The method of claim 11, further comprising depositing a number of the top coat layers on the non-image receiving side of the substrate between the substrate and the barrier layer.

* * * * *